US007503516B2

(12) United States Patent
Chen

(10) Patent No.: US 7,503,516 B2
(45) Date of Patent: Mar. 17, 2009

(54) PAPER-BREAKER SUPPORTING FRAMEWORK STRUCTURES

(75) Inventor: Liangneng Chen, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 10 days.

(21) Appl. No.: 11/468,490

(22) Filed: Aug. 30, 2006

(65) Prior Publication Data

US 2008/0054113 A1 Mar. 6, 2008

(51) Int. Cl.
*B02C 18/16* (2006.01)

(52) U.S. Cl. ..... 241/100; 241/236; 241/285.2

(58) Field of Classification Search ..... 241/236, 241/100, 285.1, 285.2, 285.3
See application file for complete search history.

(56) References Cited

U.S. PATENT DOCUMENTS 5,269,473 A * 12/1993 Strohmeyer et al. ..... 241/100
2007/0145170 A1* 6/2007 Easton et al. ..... 241/100

FOREIGN PATENT DOCUMENTS

EP 0010681 A1 * 10/1979

* cited by examiner

*Primary Examiner*—Mark Rosenbaum
(74) *Attorney, Agent, or Firm*—Bourque & Associates PA

(57) ABSTRACT

The present invention relates to a paper-breaker supporting framework structure, including the paper-breaker head and the wastebin, characterized in that the paper-breaker supporting framework structure further includes a "⊏"profiled supporting framework, the supporting framework includes an upper frame and a lower frame, the upper frame and the lower frame are connected with a movable connector, the upper frame is movably located under the paper-breaker head, the wastebin is located between the "⊏"interval of the supporting framework, the top of the wastebin is movably mounted under the paper-breaker head. With this paper-breaker supporting framework structure, the volume may be reduced to save the utility space with a simple operation, it has a simple structure and a convenient operation to meet the usual usage way; its weight is greatly reduced, and it could be easily folded, easy to be carried and transported, the transportation space and production & transportation cost may be thus reduced with a wide application range, especially suitable for SOHO members and family usage to bring a greater convenience for the routine work and life.

6 Claims, 2 Drawing Sheets

PAPER-BREAKER SUPPORTING FRAMEWORK STRUCTURES

TECHNOLOGY FIELD

The present invention relates to office equipment field, especially relates to the office paper-breaker assembling, and relates to a paper-breaker supporting framework structure.

BACKGROUND TECHNOLOGY

Various office automation equipments get more and more prevalent in modern life, the most common of which is the paper-breaker. The currently marketed paper-breaker, however, has a complete structure, it couldn't be freely dismounted, not only the weight is heavy, but also it is not easy to be carried and transported, the transportation space and production & transportation cost are thus increased, and not suitable for SOHO members and family usage.

DISCLOSURE OF THE INVENTION

The purpose of the present invention is to overcome the above drawback to provide a paper-breaker supporting framework structure that could freely dismounted with simple structure, easy to be carried, space saved and lower cost.

To achieve the above purpose, the paper-breaker supporting framework structure according to the present invention has the following constitution:

A paper-breaker supporting framework structure, including the paper-breaker head and wastebin, characterized in that the paper-breaker supporting framework structure further includes a "□"profiled supporting framework, said supporting framework includes an upper frame and a lower frame, the upper frame and lower frame are connected with a movable connector, said upper frame is movably located under the paper-breaker head, the wastebin is located between the "□"interval of the supporting framework, and the top of the wastebin is movably mounted under the paper-breaker head.

The upper frame according to the paper-breaker supporting framework structure is a kind of U-type supporting pipe, and the upper frame has a L profile.

The bottom cover of said paper-breaker head according to the paper-breaker supporting framework structure has a horizontal annular groove, the horizontal pipe of said upper frame is movably embedded into the said horizontal annular groove.

The lower frame according to the paper-breaker supporting framework structure is a kind of U-type supporting pipe, and the lower frame has a L profile.

The movable connector according to the paper-breaker supporting framework structure is a kind of connecting sheath, the U-type vertical ends of said upper frame are respectively interlinked with the corresponding U-type vertical ends of the lower frame via the connecting sheath.

The horizontal pipe of the lower frame according to the paper-breaker supporting framework structure is equipped with several foot pads.

The U-type supporting pipe frame according to the paper-breaker supporting framework structure may be a kind of U-type metal supporting pipe frame or U-type high strength plastic pipe.

The inner side of the bottom cover of the paper-breaker head according to the paper-breaker supporting framework structure is equipped with a sliding groove mechanism, the corresponding part of the top of said wastebin is equipped with a slide-rail mechanism, and said wastebin is sliding cooperated with the sliding groove mechanism of the paper-breaker head via the slide-rail mechanism.

In this paper-breaker supporting framework structure according to the present invention, the supporting framework is equipped with a L profiled upper frame and a L profiled lower frame to freely combine a "□"structure, and the "□"supporting framework is embedded into the horizontal annular groove of the bottom cover of the paper-breaker head to stably support the paper-breaker head, a "□"interval is thus formed between the paper-breaker head and ground to place the wastebin, the wastebin could freely slid in the supporting framework relative to the paper-breaker head by the sliding cooperation between the slide-rail mechanism and the sliding groove mechanism, with this structure, the supporting framework could be dismounted freely with its simple structure, and the volume may be reduced to save the utility space with a simple operation, it has a simple structure and a convenient operation to meet the usual usage way, easy to be carried and transported, the transportation space and production & transportation cost may be thus reduced with a wide application range, especially suitable for SOHO members and family usage to bring a greater convenience for the routine work and life.

PREFERRED EMBODIMENTS OF THE INVENTION

In order to explain the present invention in greater detail, the preferred embodiments will be described below with reference to the accompanying examples.

Figure 1:
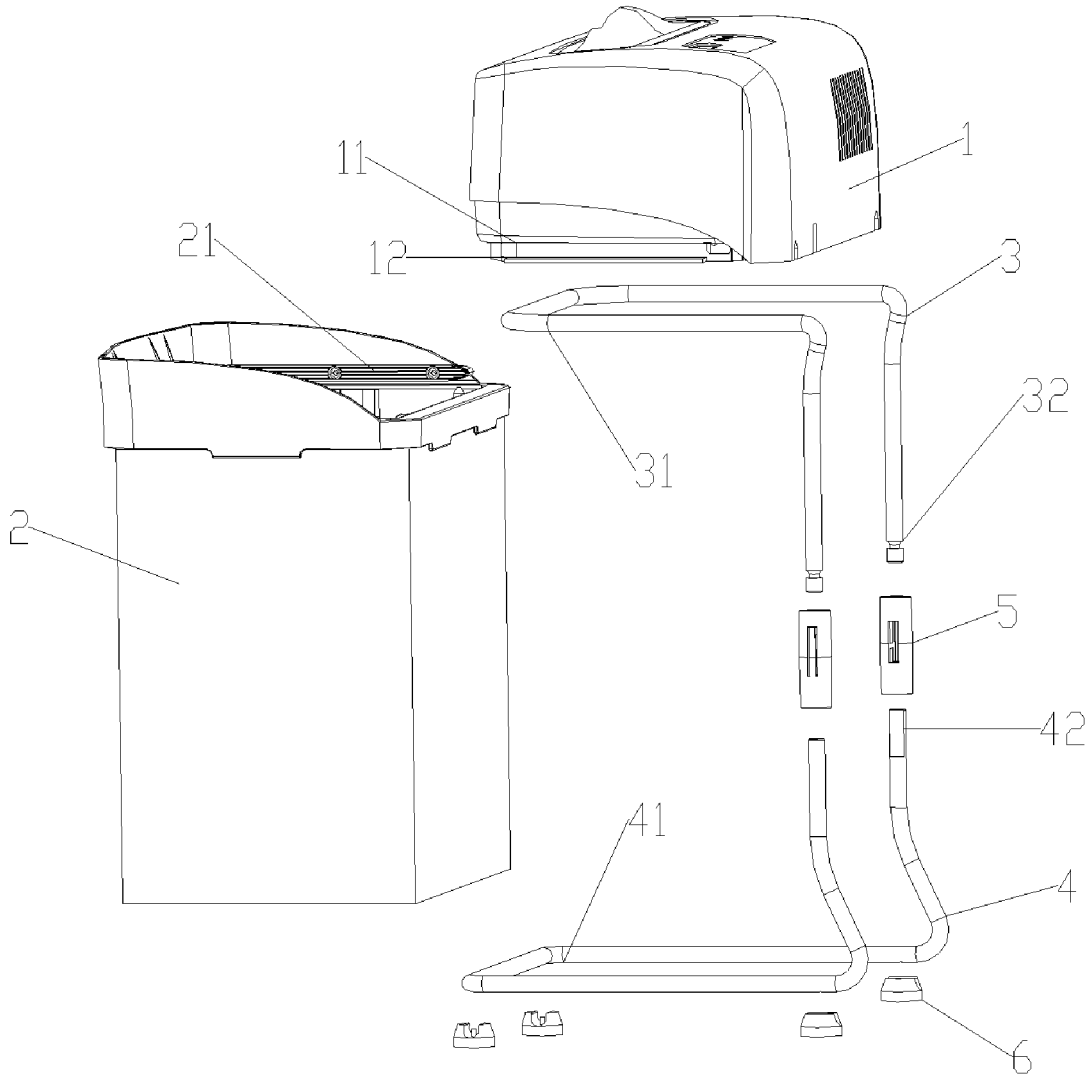
FIG. 1 is an exploded view showing the paper-breaker supporting framework structure according to the present invention.
Figure 2:
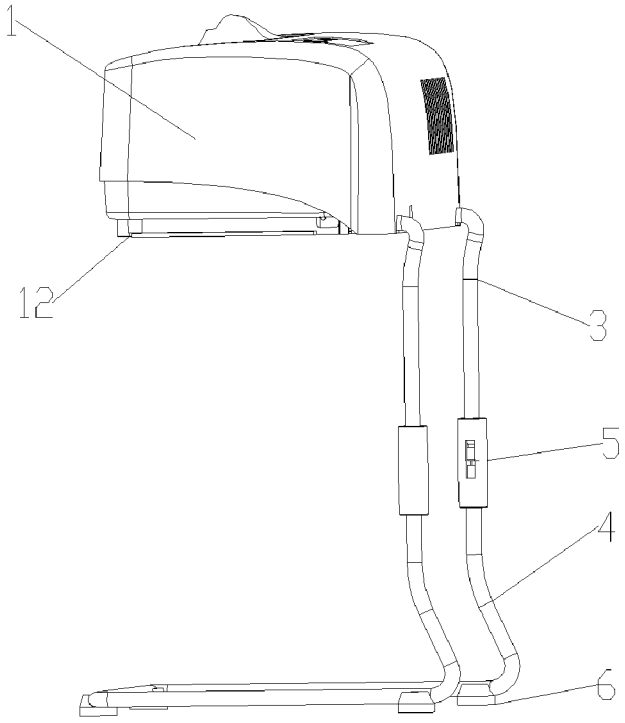
FIG. 2 is a schematic diagram showing the assembled paper-breaker supporting framework structure without the wastebin installed according to the present invention.
Figure 3:
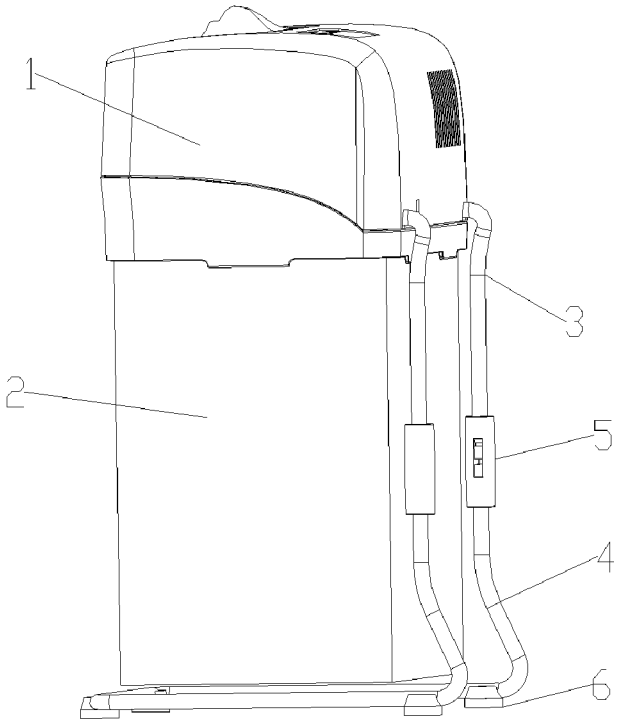
FIG. 3 is a schematic diagram showing the assembled paper-breaker supporting framework structure with the wastebin installed according to the present invention.

Refer to FIG. 1 to FIG. 3, a paper-breaker supporting framework structure, including the paper-breaker head 1 and wastebin 2, in which, said paper-breaker supporting framework structure further includes a "□"profiled supporting framework, said supporting framework includes an upper frame 3 and a lower frame 4, the upper frame 3 and the lower frame 4 are connected with a movable connector 5, said upper frame 3 is movably located under the paper-breaker head 1, the wastebin 2 is located between the "□"interval of the supporting framework, and the top of the wastebin 2 is movably mounted under the paper-breaker head 1.

In the embodiment according to the present invention, said upper frame 3 may be a kind of U-type supporting pipe 3, and the upper frame 3 may have a L profile; in application, the upper frame 3 may also have other profile to effect a stable supporting and freely dismounting.

Also, the lower frame 4 of the paper-breaker supporting framework structure may also be a kind of U-type supporting pipe 4, and the lower frame 4 has a L profile, the horizontal pipe 41 of said lower frame 4 is equipped with several foot pads 6, normally, each one is respectively set on the left and right side of the front end, and each one is respectively set on the left and right side of the rear end; in application, the lower frame 4 may also have other profile to effect a stable supporting and freely dismounting.

In case of above, said movable connector 5 is a kind of connecting sheath 5, the U-type vertical end 32 of said upper frame 3 is interlinked with the corresponding U-type vertical end 42 of the lower frame 4 via the connecting sheath 5.

Meanwhile, the bottom cover of said paper-breaker head 1 has a horizontal annular groove 11, the horizontal pipe 31 of said upper frame 3 is movably embedded into the said horizontal annular groove 11, other movable mode may be surely used to connect the paper-breaker head 1 and the supporting framework.

In this embodiment, each U-type supporting pipe frame according to the paper-breaker supporting framework structure is a kind of U-type metal supporting pipe, the metal supporting pipe may be a kind of steel pipe, aluminum pipe, copper pipe or high strength plastic pipe etc.

In order to realize flexibly taking out and setting the wastebin 2 of the paper-breaker, the inner side of the bottom cover of said paper-breaker head 1 is equipped with a sliding groove mechanism 12, the corresponding part of the top of said wastebin 2 is equipped with a slide-rail mechanism 21, and said wastebin 2 is sliding cooperated with the sliding groove mechanism 12 of the paper-breaker head 1 via the slide-rail mechanism 21.

In application, the assemblage of the paper-breaker supporting framework structure according to the present invention is as follows:

(1) Install the upper frame 3 and the lower frame 4 into the connecting sheath 5, and fix the foot pad 6 into the horizontal pipe 41 of the lower frame;

(2) Fix the assembled supporting framework into the horizontal annular groove 11 of the bottom cover of the paper-breaker head 1;

(3) Push the slide-rail mechanism 21 of the wastebin 2 into the sliding groove mechanism 12 of the bottom cover of the paper-breaker head.

In this paper-breaker supporting framework structure of above, the supporting framework is equipped with a L profiled upper frame 3 and a L profiled lower frame 4 to freely combine a "□"structure, and the "□"supporting framework is embedded into the horizontal annular groove 11 of the bottom cover of the paper-breaker head 1, that the general plastic barrel supports the paper-breaker head 1 could be replaced to stably support the paper-breaker head 1, a "□"interval is thus formed between the paper-breaker head 1 and ground to place the wastebin 2, and the wastebin 2 could freely slid in the supporting framework relative to the paper-breaker head 1 by the sliding cooperation between slide-rail mechanism 21 and sliding groove mechanism 12, with this structure, the supporting framework could be dismounted freely with its simple structure, and the volume may be reduced to save the utility space with a simple operation, it has a simple structure and a convenient operation to meet the usual usage way, easy to be carried and transported, the transportation space and production & transportation cost may be thus reduced with a wide application range, especially suitable for SOHO members and family usage to bring a greater convenience for the routine work and life.

While the present invention has been particularly shown and described with references to preferred embodiments thereof, it will be understood that various changes in form and details may be made therein without departing from the spirit and scope of the invention. It is clearly understood therefore that the same is by way of illustration and example only and is not to be taken by way of limitation.

I claim:

1. A paper-breaker supporting framework structure, including a paper-breaker head and a wastebin, characterized in that the paper-breaker supporting framework structure further includes a "[" profiled supporting framework said "[" profiled supporting framework includes an upper frame member and a lower frame member, the upper frame member and the lower frame member removably connected with a re-movable connector, said upper frame member is movably located under the paper-breaker head, the wastebin is located between the "[" interval of the supporting framework, and the top of the wastebin is movably mounted under the paper-breaker head, wherein said paper-breaker head includes a bottom cover having a horizontal annular groove and wherein said upper frame member has a horizontal pipe wherein said horizontal pipe is embedded into said horizontal annular groove of said bottom cover between said bottom cover and said paper-breaker head, further wherein an inner side of the bottom cover of said paper-breaker head is equipped with a sliding groove mechanism, the corresponding part of the top of said wastebin is equipped with a slide-rail mechanism, and wherein said wastebin slidingly engages with the sliding groove mechanism of the paper-breaker head via the slide-rail mechanism.

2. The paper-breaker supporting framework structure according to claim 1, characterized in that said upper frame is a kind of U-type supporting pipe, and the upper frame has a L profile.

3. The paper-breaker supporting framework structure according to claim 2, characterized in that said lower frame is a kind of U-type supporting pipe, and the lower frame has a L profile.

4. The paper-breaker supporting framework structure according to claim 3, characterized in that said re-movable connector is a kind of connecting sheath, the U-type vertical end of said upper frame is respectively interlinked with the corresponding U-type vertical end of the lower frame via the connecting sheath.

5. The paper-breaker supporting framework structure according to claim 3, characterized in that the horizontal pipe of said lower frame is equipped with several foot pads.

6. The paper-breaker supporting framework structure according to claim 5, characterized in that said U-type supporting pipe frame is a kind of U-type metal supporting pipe or U-type high strength plastic pipe.

* * * * *